United States Patent [19]

Hayden et al.

[11] 3,997,105

[45] Dec. 14, 1976

[54] SWINGING BUCKET CENTRIFUGE ROTOR

[75] Inventors: Mark William Hayden, Bridgeport; John Francis Williams, New Canaan, both of Conn.

[73] Assignee: E. I. Du Pont de Nemours and Company, Wilmington, Del.

[22] Filed: Apr. 11, 1975

[21] Appl. No.: 567,438

[52] U.S. Cl. ..... 233/26

[51] Int. Cl.[2] ..... B04B 9/12

[58] Field of Search ..... 233/26, 27, 1 R, 11, 233/14 R, 14 A, 26

[56] References Cited

UNITED STATES PATENTS

| | | | |
|---|---|---|---|
| 3,393,864 | 7/1968 | Galasso et al. | 233/26 |
| 3,752,390 | 8/1973 | Chulay | 233/26 |

FOREIGN PATENTS OR APPLICATIONS

| | | | |
|---|---|---|---|
| 505,446 | 5/1939 | United Kingdom | 233/26 |

*Primary Examiner*—George H. Krizmanich

[57] ABSTRACT

A swinging bucket centrifuge rotor has a plurality of peripheral cavities each adapted to seat a swinging bucket suspended from a fixed hanger. The hanger defines a hook which is adapted to support a cross-pin located in each bucket cap. Each bucket cap in turn is formed such that the shaft supporting the cross-pin is spring-loaded to permit its movement along the axis of the bucket. In this manner, a single rotor may accommodate different weight sets of buckets simply by varying the spring constant of the spring in the bucket cap.

7 Claims, 3 Drawing Figures

SWINGING BUCKET CENTRIFUGE ROTOR

BACKGROUND OF THE INVENTION

This invention relates to centrifuge rotors and, more particularly, to the swinging bucket type of centrifuge rotor.

Swinging centrifuges typically include a rotor having a plurality of peripheral cavities therein. Each cavity houses a swinging member, usually referred to as a bucket, which holds the material to be centrifuged. The buckets are pivotally mounted in each cavity, such that they normally hand with a vertical orientation. As the rotor increases speed, the buckets, because of centrifugal force, swing outwardly and desirably assume a horizontal position. The pivotal mounting is provided with some means of flexure by which the buckets, under the influence of extreme centrifugal force at their high speed of rotation, are permitted to move radially outward until they are supported by or seated within the rotor cavity itself such that they are restrained from further outward movement. The reverse sequence occurs as the rotor is slowed down, i.e., the buckets are retracted radially inward such that they unseat from the rotor cavity and are allowed to swing back down to a vertical orientation.

Among the early designs of these type of rotors, flexure was provided by elongated pins which extend through a section of the rotor. Unfortunately these pins required a relatively large amount of rotor space and severely limited the number of cavities and, hence, the number of buckets that could be positioned within one rotor.

An improvement over this design which permitted the use of more swinging buckets in a given rotor was provided by Galasso et al. in U.S. Pat. No. 3,393,864, issued July 23, 1968. Galasso et al. taught that each of the buckets is supported by an independent bucket hanger assembly disposed within a cavity in the rotor. Each hanger assembly is spring biased in a radially inward sense toward the axis of rotation of the rotor and includes a separate pin member carried by the assembly from which a bucket can be suspended. While the Galasso et al. apparatus was a vast improvement over the elongated pin montings, it unfortunately has many disadvantages. Among these disadvantages, the hanger mounting screws can and do become loosened with use and vibration and the required precise positioning of that bucket is lost. The bucket can then rotate which may cause it to drop off or not seat properly. Either results in an unbalanced rotor and can cause possible rotor spin-off at high speed. The resulting damage can be very expensive.

Another swinging bucket rotor is described by Chulay, in U.S. Pat. No. 3,752,390, issued Aug. 14, 1975. In Chulay the rotor cavities each have a vertically positioned torsion bar extending downwardly through the rotor into the bucket cavity. A disadvantage of the Chulay assembly, as well as the Galasso et al. assembly, is that the bucket, which must be precisely mounted, can easily be mounted improperly, e.g., backwards, by the careless user. This can result in rotor unbalance. Further, the buckets can be improperly mounted such that they are not securely positioned by the hook support provided. In this case, the buckets may fly off as soon as the rotor begins operation.

The disadvantages of both Chulay and Galasso et al. are overcome to a large extent by a centrifuge rotor developed by John Williams and Mark Hayden. According to Williams et al., the hanger is slidably positioned in a receptacle which prevents its rotation about its path of movement. The hanger hook provided by Williams et al. supports a cross-pin located in the bucket cap. The hook is formed with a downwardly sloping entrance opening so that the bucket can only be mounted in a proper manner. Further, the cross-pin is designed to permit only a proper mounting of the bucket.

One disadvantage of Williams et al. as well as Galasso et al. and Chulay is that the range of different weight buckets that can be used with a single rotor is somewhat limited. If buckets having a weight outside this permitted range are to be used, the hanger assembly must be changed, which is somewhat time consuming and cannot, of corse, be accomplished until the rotor is not in use.

Accordingly, it is an object of this invention to obviate many of the disadvantages of the prior art swinging bucket type centrifuges.

An additional object of this invention is to provide an improved centrifuge rotor which is capable of accommodating more than one weight sets of swinging members.

A further object of this invention is to provide an improved centrifuge rotor in which the swinging member is provided with a spring loaded cap.

BRIEF DESCRIPTION OF THE INVENTION

According to a preferred embodiment of this invention, a swinging bucket centrifuge is constructed in which the rotor is adapted to turn about its axis and defines a plurality of peripheral cavities therein. Each of the cavities is adapted to seat a different swinging bucket. A hanger assembly is provided in each cavity for pivotally supporting a bucket nominally in a vertical position and yet permitting the bucket to swing under the influence of centrifugal force to a horizontal position during operation. Each hanger assembly is secured within a given rotor cavity. According to a preferred embodiment of this invention, each swinging member is provided with a spring loaded cap such that the swinging member is capable of radial movement during operation thereby to permit the seating of the buckets within the rotor cavities. In this manner, different weight sets of the swinging buckets may be pivotally mounted on the same rotor.

In a particularly preferred embodiment, the cap of each bucket is provided with a coupling means which includes a spring means biasing the swinging bucket radially inward toward the axis of rotor spin. The coupling means includes a cross-pin adapted to pivotally engage a fixed hook of the hanger assembly.

BRIEF DESCRIPTION OF THE DRAWINGS

The novel features of this invention, as well as the invention itself, both as to its organization and method of operation, will best be understood from the following description when read in connection with the accompanying drawing, in which like reference numerals refer to like parts, and in which.

DETAILED DESCRIPTION OF THE PREFERRED EMBODIMENTS

Figure 1:
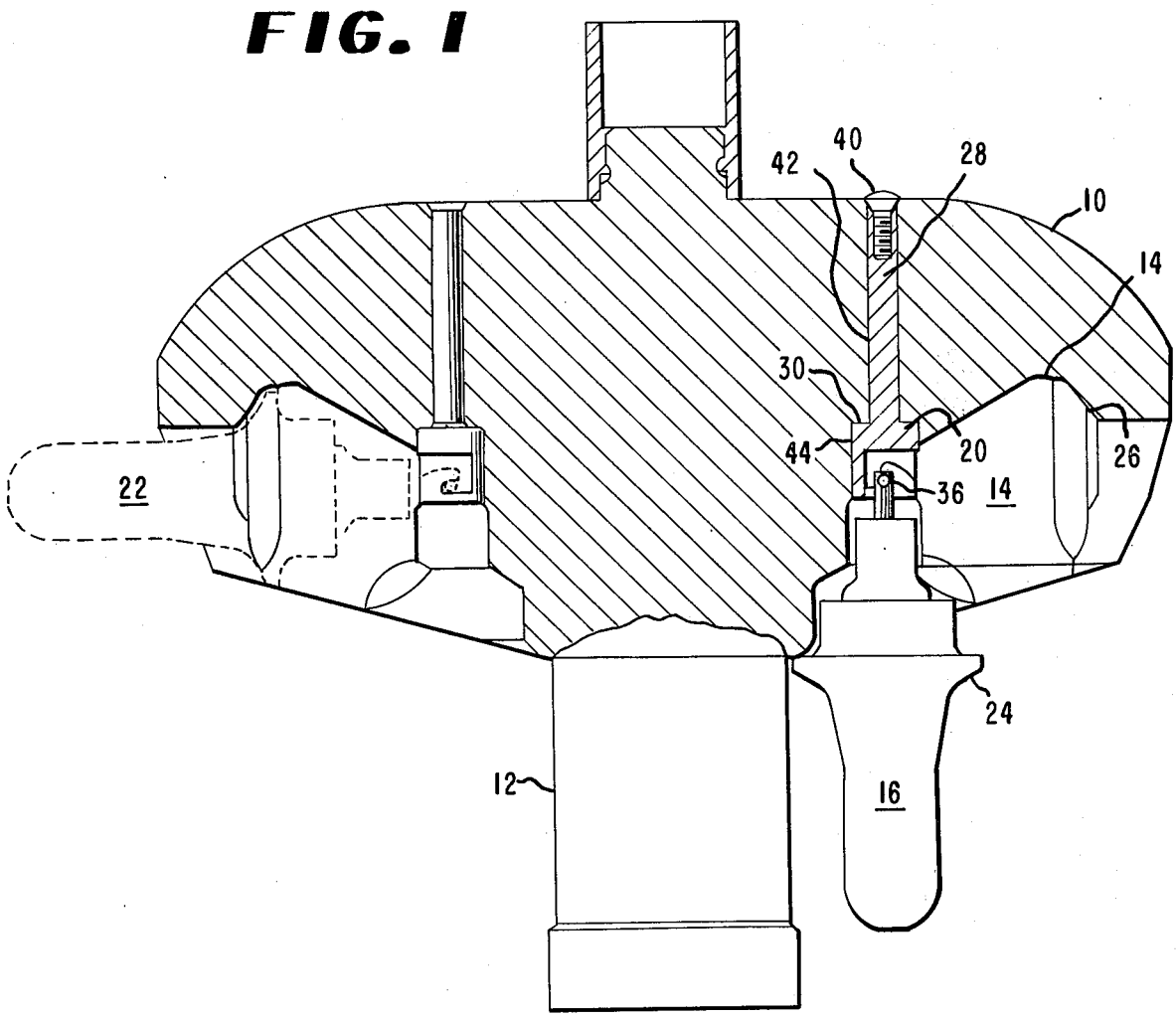
FIG. 1 is an elevation view partially cut away of the rotor assembly of a swinging bucket type centrifuge depicting the manner of mounting the swinging buckets in accordance with this invention, with a bucket in the horizontal position prior to seating depicted in phantom.
Figure 3:
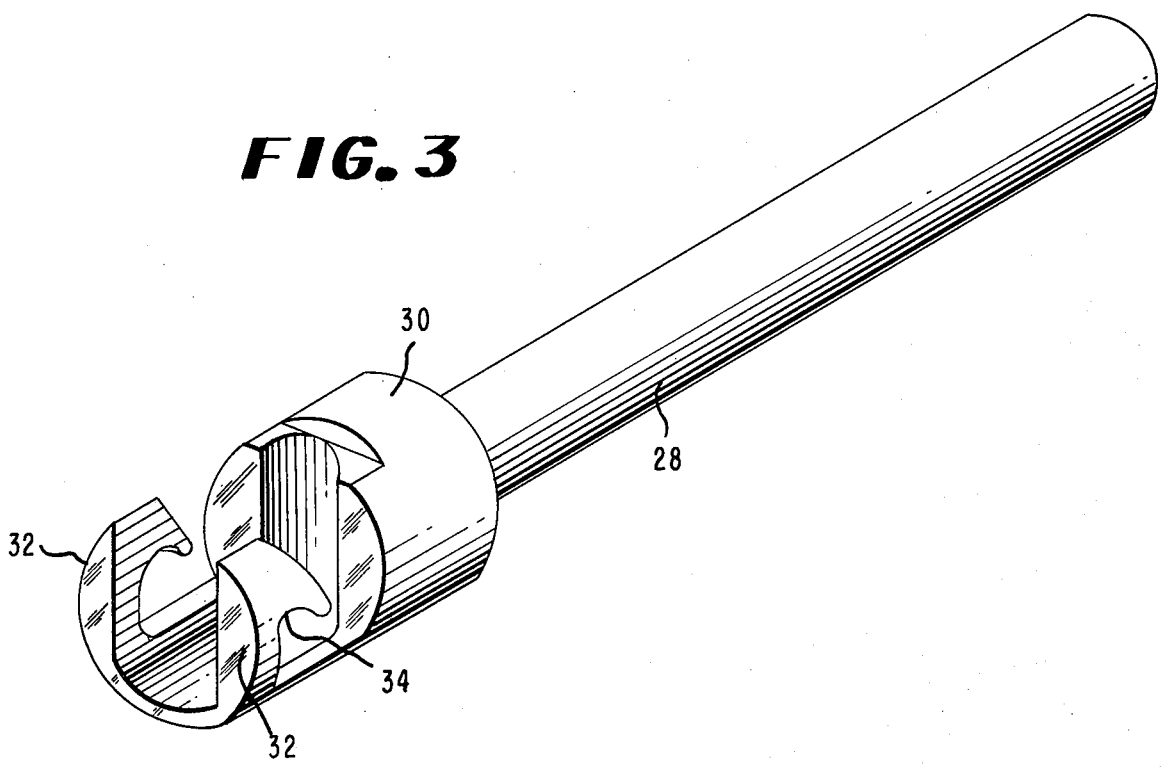
FIG. 3 is a fragmentary pictorial view of the hanger assembly utilized in FIGS. 1 and 2.

There is seen in FIG. 1 an otherwise conventional centrifuge rotor 10. The rotor is mounted on a drive shaft 12 which is driven by suitable means, i.e., an electric motor, appropriate gears, mountings and the like. Disposed about the peripheral portions of the rotor 10 are cavities 14 only two of which are shown. A swinging member or bucket 16 is pivotally supported or hung within each cavity. Each swinging bucket 16 has a plug or cap 18. The buckets are adapted to contain the material or fluid which is to be centrifuged and are usually constructed of a light weight metal capable of withstanding the large centrifugal forces to which the bucket is subjected during the centrifuge operation such as aluminum or titanium. The buckets are each pivotally hung from or supported by a fixed hanger assembly 20 constructed in accordance with this invention, as will be described.

Figure 2:
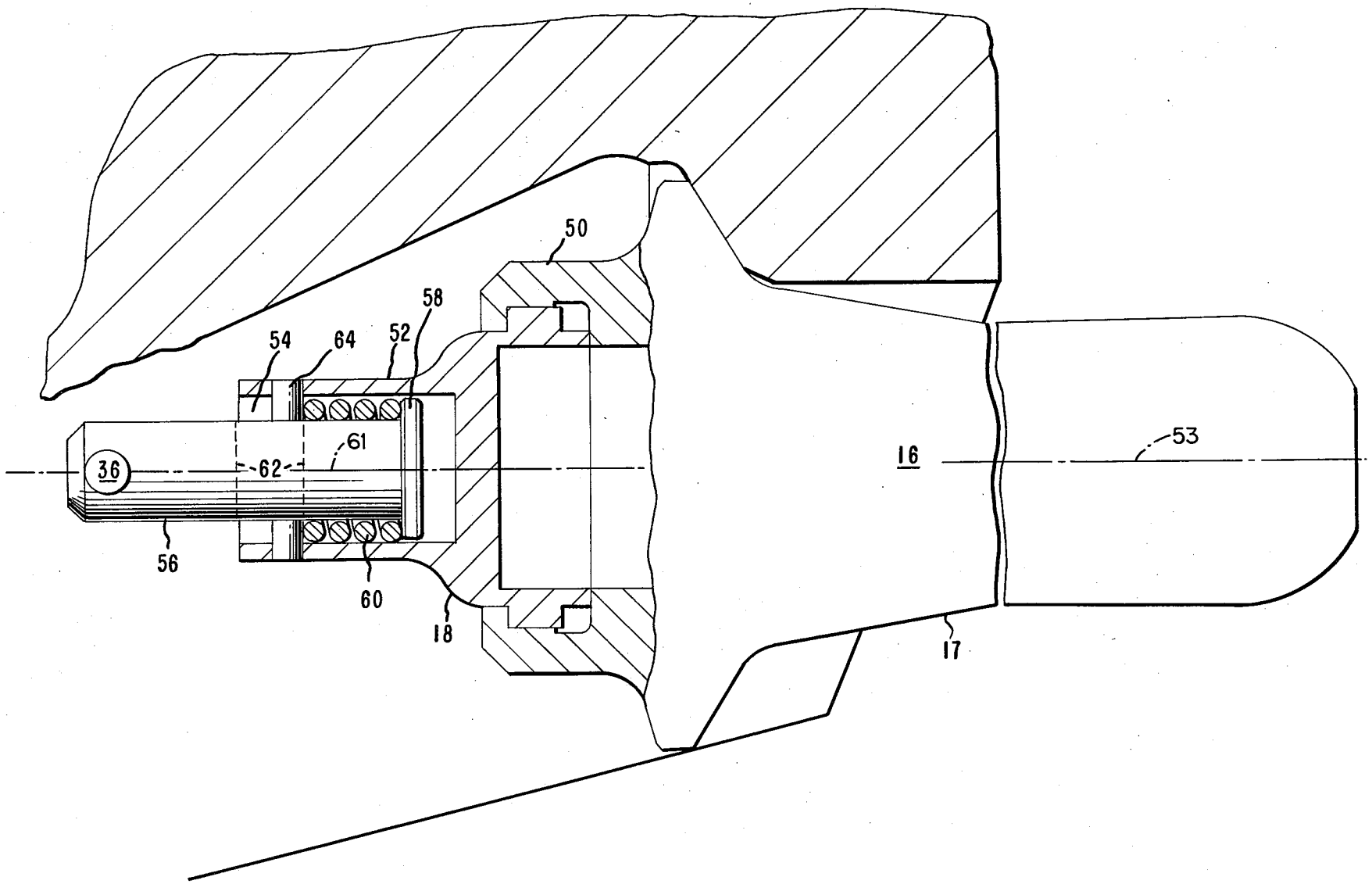
FIG. 2 is a fragmentary section view of a rotor cavity illustrated in FIg. 1 depicting a seated bucket.

The swinging bucket 16 is depicted (in the right side of the drawing) in a vertical position which is the orientation of the buckets when the rotor is at rest. When the rotor is in operation and spinning, the buckets swing pivotally to a horizontal position depicted in phantom by the dashed line 22 (in the left side of the drawing) of FIG. 1. As the spin speed increases, the centrifugal force is such that the buckets pivot radially outward until their flanged collar or shoulder 24 engages a recess or shoulder seat 26 formed in the interior of the outer portion of each cavity 14 such that when the bucket is subjected to extreme centrifugal forces, it may seat within the shoulder seat 26 as is depicted particularly in FIG. 2.

In accordance with this invention, the hanger assembly is constructed to have a stem 28 at the lower end of which is an enlarged portion 30 which forms a yoke or split arm 32. The end portions of the split arm 32 define a pair of hooks 34 which are adapted to engage a cross-pin 36 on the swinging member or bucket 16 as will be described. The other end of the stem 28 has a bore formed therein which is threaded to accommodate a head screw 40. Each stem 28 is adapted to fit snugly within an axial bore 42 formed within the rotor 10. Each axial bore 42 is positioned to intersect the rear portion of a different cavity 14 with the split arms 32 opening vertically into the cavity and the hooks 34 opening horizontally into the cavity. Thus, when the stem 28 is introduced upwardly into the bore 42 and the head screw threaded into the internally threaded bore 36 and tightened, the hanger assembly 20 is rigidly fixed in position in each cavity. The lower end of the bore 32 is counterbored at 44 to accommodate the enlarged portion 30 of the stem 28.

Further in accordance with this invention, the cap 18 of a swinging bucket 16 is adapted to fit within the threaded open end or mouth 50 of the lower portion 17 of the bucket 16 in a wellknown manner. Alternatively, of course, the cap may fit over the lower portion 17. This cap 18 is formed to have an enlarged head portion 52 which extends outward from the bucket along the axis 53 of the bucket. This head portion 52 has a bore 54 adapted to receive a shaft 56 having an enlarged end or head portion 58 which fits in a sliding manner within the bore 54. A helical compression spring 60 having an axis 61 fits over the shaft. It is restrained between the head portion 58 and a retaining pin 64 which is fitted through the walls of the open ended cylinder or head portion 52. The retaining pin 64 is fitted through the walls of the open ended cylinder with a friction fit and passes through an elongated slot 62 forwad within the shaft 56. In this manner, the shaft is capable of axial movement within the limits of the slot 62. As may be seen from FIG. 2 of the drawing, the axis 61 of the spring 60 is parallel to the axis 53 of the bucket.

The remote end of the shaft 56 is provided with a cross-pin 36 which may be frictionally engaged therein and is adapted, as described, to pivotally engage the hooks 34 of the hanger assembly 20. The stem and the several parts comprising the hanger assembly may be formed of any suitable light weight material such as aluminum or titanium, the spring being formed of spring steel.

In operation, a matched or equal weight set of swinging buckets 16 is hung with the respective buckets each on a corresponding hanger assembly in each of the rotor cavities with the cross-pins 36 of each bucket engaging the hook portion 36 of each hanger assembly. As the rotor spins, the normally vertically oriented buckets 16, as seen in FIG. 1, gradually swing outwardly until they assume the horizontal position depicted by the dashed lines of FIG. 1 with their axes generally horizontally aligned. As the spin speed continues to increase, the centrifugal forces acting against the bias of the spring 60 cause the shaft 56 to withdraw somewhat from the bore 50 (FIG. 2) within the limits permitted by the axial length of the slot 62, until the shoulder 24 of the buckets seats against the seat 26 provided in each cavity of the rotor. With deceleration of the rotor, the reverse occurs, i.e., the spring acts to retract the shaft 56 again into the head of the cap 18 of the bucket 16 following which the buckets each pivot downwardly until they again assume a vertical orientation when the rotor is stopped.

A particular advantage of this invention is that different weight sets of buckets may be used with any given rotor. This is accomplished simply by changing the springs of the several buckets to select a spring having a different spring constant that can accommodate the particular weight buckets that are to be used. Thus, with larger weight buckets a spring having a higher spring constant is used and with lesser weight buckets, springs having lower spring constants are selected. This is an operation simply performed by the expedient of removing the retaining pin 64, removing the spring, inserting a new spring, and reintroducing the retaining pin. The springs or caps may be changed on one set of buckets while another is in use — thus one does not have to await the end of a run before changing springs. The remaining components are unchanged. The spring constant is selected such that the buckets are permitted to assume a horizontal orientation before the bucket is permitted to extend radially and become seated in the rotor.

A further advantage of this invention lies in the fact that the cross-pin 36 can be mounted if desired, on the axis of the bucket. Because of this there is no incorrect position for mounting the buckets so long as the cross-pin 36 properly engages the hook. A positive means is provided such that the proper engagement of the hook always takes place. This means includes the downwardly sloping upper surfaces 70 of the split arms 32.

Thus if the cross-pin 36 is not properly introduced into and engaged by the hooks 34, it will immediately slide off and cannot be mounted, thereby averting probable damage to the rotor.

We claim:

1. In a centrifuge having a rotor which defines a plurality of peripheral cavities therein and is adapted to turn about its axis, each said cavity adapted to pivotally support a bucket therein nominally in a vertical orientation and yet permitting said bucket to swing under the influence of centrifugal force to a horizontal orientation during operation, the improvement comprising: a fixed hanger in each said cavity attached solely to said rotor, and each said bucket having a detachable cup, coupling means secured solely to each said cap for pivotally engaging said hanger, said coupling means including spring means for biasing said cap and hence said bucket toward said hanger and hence radially inward toward said rotor axis when said bucket is in a horizontal orientation, whereby different weight sets of buckets may be used with said rotor simply by changing said spring means.

2. A centrifuge according to claim 1 wherein said hanger is substantially inflexible.

3. A centrifuge according to claim 2 wherein said bucket has an axis and said spring means is a helix positioned in said cap and always has an axis parallel to the axis of said bucket.

4. A centrifuge according to claim 2 wherein said hanger includes a hook and said coupling means includes a cross-pin adapted to pivotally engage said hook.

5. A centrifuge according to claim 3 wherein said rotor defines a bore having an axis parallel to the rotor axis opening into each said cavity, one said hanger secured in each said bore with the hook opening into the cavity.

6. A centrifuge according to claim 1 wherein said rotor defines a bore having an axis parallel to the rotor axis opening into each said cavity, one said hanger secured in each said bore.

7. A centrifuge according to claim 1 wherein each said spring means of each set of buckets has a spring constant which is selected according to the weight of said buckets.

* * * * *